US008518862B2

(12) United States Patent
Kato et al.

(10) Patent No.: US 8,518,862 B2
(45) Date of Patent: Aug. 27, 2013

(54) ANTI-SEIZING AGENT, SENSOR AND ASSEMBLY INCLUDING SENSOR

(75) Inventors: Akiyoshi Kato, Komaki (JP); Naoki Yamada, Iwakura (JP); Noboru Fujita, Kuwana (JP); Takuya Takase, Inabe (JP)

(73) Assignee: NGK Spark Plug Co., Ltd., Aichi (JP)

( * ) Notice: Subject to any disclaimer, the term of this patent is extended or adjusted under 35 U.S.C. 154(b) by 888 days.

(21) Appl. No.: 11/604,760

(22) Filed: Nov. 28, 2006

(65) Prior Publication Data

US 2007/0123436 A1 May 31, 2007

(30) Foreign Application Priority Data

Nov. 28, 2005 (JP) ..... P2005-341440
Sep. 25, 2006 (JP) ..... P2006-259640

(51) Int. Cl.
*C10M 125/04* (2006.01)
*C10M 125/10* (2006.01)
*C10M 169/04* (2006.01)

(52) U.S. Cl.
USPC ..... 508/103; 508/108; 508/109; 508/113; 508/150; 508/155; 508/390

(58) Field of Classification Search
USPC ..... 508/188, 103, 108, 109, 113, 150, 508/155, 189, 390
See application file for complete search history.

(56) References Cited

U.S. PATENT DOCUMENTS 2,449,010 A * 9/1948 Barnett et al. ..... 585/3
4,557,839 A 12/1985 Tubbs et al.
4,915,856 A * 4/1990 Jamison ..... 508/103
4,965,001 A 10/1990 King
5,536,422 A 7/1996 Oldiges et al.
5,922,654 A * 7/1999 Yamazaki et al. ..... 508/364
6,606,900 B2 * 8/2003 Murase et al. ..... 73/31.06
6,864,307 B2 3/2005 Niwa et al.
8,003,582 B2 8/2011 Mikami
2002/0020210 A1 2/2002 Murase et al.
2002/0037992 A1 3/2002 Niwa et al.

(Continued)

FOREIGN PATENT DOCUMENTS

CN 1078488 A 11/1993
EP 1719812 A1 11/2006

(Continued)

OTHER PUBLICATIONS

Romp-Lexikon Chemie, Georg Thieme Verlag, Stuttgart 1997, ISBN 3-13-734810-2, vol. 3, 10th Edition, pp. 2314-2315, "Kupferoxide" (copper oxides).

(Continued)

*Primary Examiner* — Taiwo Oladapo
(74) *Attorney, Agent, or Firm* — Sughrue Mion, PLLC

(57) ABSTRACT

An anti-seizing agent including: a first solid lubricant containing at least one of bismuth and a bismuth compound; and a second solid lubricant containing at least one of graphite, molybdenum disulfide and boron nitride. The anti-seizing agent satisfies the relationships 20 weight %≦a≦90 weight % and 10 weight %≦d≦80 weight %, in which a sum of the contents of the first solid lubricant and the second solid lubricant in the anti-seizing agent is taken as 100 weight %, and a represents a content of the first solid lubricant and d represents a content of the second solid lubricant.

8 Claims, 1 Drawing Sheet

(56) References Cited

U.S. PATENT DOCUMENTS

| | | | | |
|---|---|---|---|---|
| 2003/0008169 | A1 | 1/2003 | Sakai et al. | |
| 2004/0058828 | A1 | 3/2004 | Iwata et al. | |
| 2004/0092408 | A1 | 5/2004 | Willey et al. | |
| 2004/0166341 | A1 | 8/2004 | Iwata et al. | |
| 2004/0180796 | A1 | 9/2004 | Iwata et al. | |
| 2004/0214732 | A1* | 10/2004 | Oldiges et al. | 508/390 |
| 2007/0123436 | A1 | 5/2007 | Kato et al. | |
| 2007/0154128 | A1 | 7/2007 | Mikami | |
| 2011/0207535 | A1 | 8/2011 | Mikami | |

FOREIGN PATENT DOCUMENTS

| | | | |
|---|---|---|---|
| JP | 58-215494 | A | 12/1983 |
| JP | 59-174699 | A | 10/1984 |
| JP | 59-174699 | A | 10/1984 |
| JP | 61-152797 | A | 7/1986 |
| JP | 02-069596 | A | 3/1990 |
| JP | 2-69596 | A | 3/1990 |
| JP | 02-308895 | A | 12/1990 |
| JP | 5-163498 | A | 6/1993 |
| JP | 05-163498 | A | 6/1993 |
| JP | 8-19435 | A | 2/1996 |
| JP | 11-190720 | A | 7/1999 |
| JP | 11-246823 | A | 9/1999 |
| JP | 11-246823 | A | 9/1999 |
| JP | 2000-282259 | A | 10/2000 |
| JP | 2001-249106 | A | 9/2001 |
| JP | 2001-303085 | A | 10/2001 |
| JP | 2002-053673 | A | 2/2002 |
| JP | 2004-115577 | A | 4/2004 |
| JP | 2004-277787 | A | 10/2004 |
| JP | 2005-255977 | | 9/2005 |
| JP | 2007-169597 | A | 7/2007 |
| WO | 2005/075610 | A1 | 8/2005 |

OTHER PUBLICATIONS

Handbook of Solid Lubricant; "Application of Solid Lubricant"; pp. 409-417; published 1978.

Sumi Paste NS; "Graphite and Various Metal Combination Rust Prevention Strengthening Type"; published 2004.

* cited by examiner

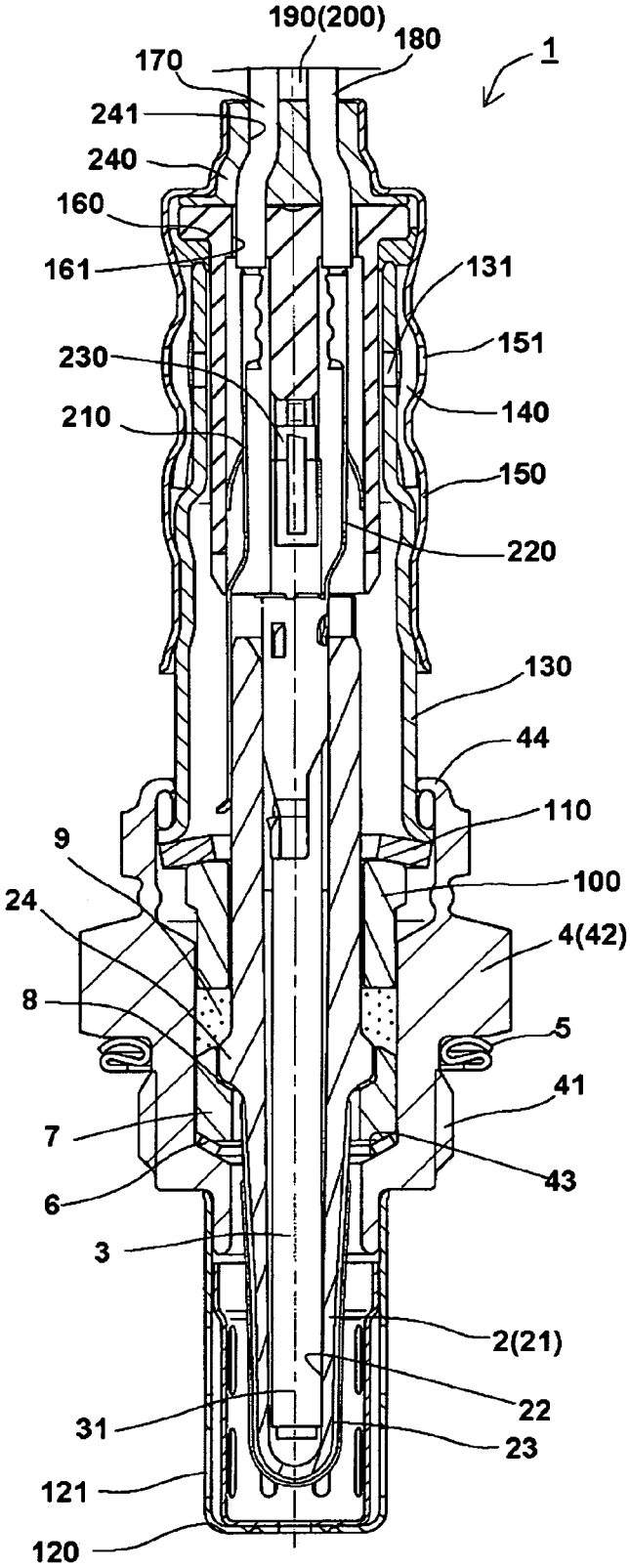
190(200)
180
1
170
241
240
160
161
131
151
230
140
210
150
220
130
44
110
9
100
24
4(42)
8
5
41
7
43
6
3
2(21)
22
31
23
121
120

ANTI-SEIZING AGENT, SENSOR AND ASSEMBLY INCLUDING SENSOR

CROSS-REFERENCE TO RELATED APPLICATIONS

This application claims benefit of Japanese Patent Application No. 2005-341440, filed Nov. 28, 2005 and Japanese Patent Application No. 2006-259640, filed Sep. 25, 2006, the above-noted applications incorporated herein by reference in their entirety.

BACKGROUND OF THE INVENTION

1. Field of the Invention

The present invention relates to an anti-seizing agent. Particularly, the present invention relates to an anti-seizing agent for preventing seizing of parts that may be exposed to high temperatures of 500° C. or higher, and a sensor and an assembly including the sensor, using the anti-seizing agent.

2. Description of the Related Art

An anti-seizing agent is often applied to a screw portion of a metal part to prevent seizing, and the part is then used for fabrication. The metal part includes a metal shell of a gas sensor fitted to an exhaust pipe or the like of an internal combustion engine used to detect a specified gas component in a gas to be measured, and a metal shell of a temperature sensor fitted to an exhaust pipe or the like to detect the temperature of a gas to be measured. Examples of the anti-seizing agent include a paste-like anti-seizing agent comprising a lubricant base oil and a solid lubricant contained therein, and a paste-like anti-seizing agent comprising a grease obtained by semi-solidifying a lubricant base oil with a thickening agent, and a solid lubricant contained therein (for example, see Masahisa Matsunaga, et al., *Handbooks of Solid Lubrication*, pp. 409-416, Saiwai Shobo Co., (1978)).

Conventionally, a solid lubricant comprising a metal such as copper, aluminum or nickel, as a main component, and according to need, molybdenum disulfide or graphite combined therewith, is widely used in a paste-like anti-seizing agent that is applied to a metal part that may be exposed to high temperatures of 500° C. or higher (for example, see JP-B-8-19435).

The mechanism which allows these metals to prevent seizing is considered to be as follows. A paste-like anti-seizing agent containing the above-noted metals is applied to the requisite portion of a metal part to thereby form a uniform intervening film on the metal part. When the metal part is fabricated with another part, the intervening film is present between the metal part and the other part. As a result, when the metal part is exposed to high temperatures and then disassembled from the other part (when the metal part and the other part slide), seizing between the metal part and the other part is prevented by the lubricating action due to the softness of the metals constituting the intervening film.

3. Problems to be Solved by the Invention

However, when the metal part is fabricated with another part, the uniform intervening film formed on the metal part is localized so as to be present on only one portion in between the metal part and the other part. In such a case, a site at which the metal part and the other part are in direct contact is present, and as a result, the anti-seizing effect is not obtained.

For this reason, there is a need for an anti-seizing agent which forms an intervening film over the entire surface between a metal part and the other part even when the metal part and the other part slide, thereby exhibiting the desired anti-seizing effect.

In particular, an anti-seizing agent having sufficient seizing preventing performance for a sensor used under severe conditions at high temperature has hitherto not yet been achieved.

SUMMARY OF THE INVENTION

It is therefore an object of the present invention to provide an anti-seizing agent that can solve the above-noted problems of the prior art, a sensor and an assembly including the sensor. That is, an object of the present invention is to provide an anti-seizing agent capable of forming an intervening film over the entire contact area between a metal part and another part even when the metal part and the other part slide, and where the metal part is exposed to a high temperature of 500° C. or higher, and a sensor and an assembly including the sensor, using the anti-seizing agent.

The above object of the present invention has been achieved by providing an anti-seizing agent comprising a first solid lubricant containing at least one of bismuth and a bismuth compound and a second solid lubricant containing at least one of graphite, molybdenum disulfide and boron nitride, wherein the anti-seizing agent satisfies 20 weight %≦a≦90 weight % and 10 weight %≦d≦80 weight %, in which the sum of the contents of the first solid lubricant and the second solid lubricant in the anti-seizing agent is taken as 100 weight %, and a represents the content of the first solid lubricant and d represents the content of the second solid lubricant.

In a preferred embodiment, the contents of the first solid lubricant and the second solid lubricant satisfy the relationship $0.8 \leqq a/d \leqq 8$.

In yet another preferred embodiment, the first solid lubricant is one of bismuth and a bismuth compound, the anti-seizing agent further contains an antioxidant comprising at least one of copper oxide, thallium oxide, iridium oxide, osmium oxide, rhodium oxide and ruthenium oxide, and when the sum of the contents of the first solid lubricant and the second solid lubricant is taken as 100 parts by weight, the content of the antioxidant is e satisfies 10 parts by weight≦e≦100 parts by weight.

In yet another preferred embodiment, the anti-seizing agent further contains a lubricant base oil, or a lubricant base oil and a thickening agent, and when a sum of the contents of the first solid lubricant and the second solid lubricant is taken as 100 parts by weight, and the content b of the lubricant base oil, or the sum b of the contents of the lubricant base oil and the thickening agent when present satisfies 90 parts by weight≦b≦400 parts by weight.

In yet another preferred embodiment, the anti-seizing agent further contains an organic resin, wherein, when the sum of the contents of the first solid lubricant and the second solid lubricant is taken as 100 parts by weight, and the content of the organic resin is c, the relationship 90 parts by weight≦c≦400 parts by weight is satisfied.

The anti-seizing agent is preferably applied to a metal part.

In particular, in a sensor having a detecting element that detects the state of a gas to be measured, and a metal shell that holds the detecting element, the metal shell having a fitting part that fits the detecting element to an exhaust pipe when exposing the detecting element to a gas to be measured, the anti-seizing agent is preferably applied to an outer surface of at least the fitting part of the metal shell.

Further, in an assembly including a sensor having a detecting element that detects a state of gas to be measured, and a metal shell that holds the detecting element; and an exhaust pipe that fits a fitting part formed on the metal shell of the sensor to expose the detecting element to a gas to be measured, the anti-seizing agent is preferably present between an outer surface of the fitting part of the metal shell and a surface of the exhaust pipe that fits the fitting part when the sensor and the exhaust pipe are assembled, and after heating the fitting part to a temperature of 270° C. or higher, a bismuth component of the anti-seizing agent remains on a central portion of the outer surface of the fitting part.

The anti-seizing agent of the invention provides an excellent anti-seizing effect, particularly to a metal part that may be exposed to a high temperature of 500° C. or higher, particularly to a fitting part of a metal shell of a sensor.

BRIEF DESCRIPTION OF THE DRAWINGS

The FIGURE is a cross sectional view of the gas sensor 1 according to an embodiment of the present invention.

DESCRIPTION OF REFERENCE NUMERALS

Reference numerals used to identify various structural features drawings include the following.

| | |
|---|---|
| 1 | Gas sensor |
| 2 | Gas sensor element |
| 3 | Heater |
| 4 | Metal shell |
| 7 | Supporting member |
| 9 | Filling member |
| 100 | Sleeve |
| 120 | Protector |
| 130 | Inner cylinder member |
| 140 | Filter |
| 150 | Outer cylinder member |
| 160 | Separator |
| 240 | Sealing member |
| 136 | Filter part |
| 200, 300 | Filter covering member |
| 201, 301 | Covering part |
| 202, 302 | Opening |
| 203, 303 | Insertion portion |

DETAILED DESCRIPTION OF THE INVENTION

The anti-seizing agent of the present invention contains a first solid lubricant and a second solid lubricant.

The first solid lubricant comprises at least one of bismuth and a bismuth compound, as a main component. The present inventors consider that the anti-seizing agent can prevent seizing of a metal part by the following mechanism. The anti-seizing agent is applied to a requisite portion of the metal part, to thereby form a uniform intervening film. When the metal part is fabricated with another part, the anti-seizing agent is localized to one portion, and as a result, becomes present on only one portion or in isolated portions in between the metal part and the other part such that there is direct contact at other portions. However, when the metal part is exposed to a high temperature, bismuth in the anti-seizing agent melts and permeates over the entire interface between the metal part and the other part, thereby again forming an intervening film. This makes it possible to prevent seizing by the lubricating action of the intervening film when sliding the metal part against the other part.

The bismuth compound of the first solid lubricant includes bismuth oxides. These compounds are commercially available, and have an average particle diameter of 100 μm or less, and preferably 30 μm or less.

The second solid lubricant comprises at least one of graphite, molybdenum disulfide and boron nitride. The present inventors consider that by further introducing the second solid lubricant, the second solid lubricant permeates simultaneously when bismuth permeates between the metal part and the other part, such that the second solid lubricant is present between the metal part and the other part. This makes it possible to further improve lubricating performance.

The content a of the first solid lubricant and the content d of the second solid lubricant in the anti-seizing agent of the present invention satisfy 20 weight %≦a≦90 weight % and 10 weight %≦d≦80 weight % when a+d is taken as 100 weight %. When a is less than 20 weight % (d exceeds 80 weight %), it becomes difficult to form the intervening film, and the anti-seizing effect deteriorates. On the other hand, when a exceeds 90 weight % (d is less than 10 weight %), the amount of the second solid lubricant in the intervening film is too small, and the anti-seizing effect may not be obtained.

The content a of the first solid lubricant and the content d of the second solid lubricant in the anti-seizing agent of the present invention preferably satisfy the relationship 0.8≦a/d≦8. When a/d is less than 0.8, it is difficult to form the intervening film, and the anti-seizing effect may deteriorate. On the other hand, when a/d exceeds 8, the amount of the second solid lubricant in the intervening film is too small, and the anti-seizing effect may not be obtained.

Of the anti-seizing agents of the present invention, when the anti-seizing agent containing bismuth or a bismuth compound as the first solid lubricant is applied to a metal part, and such a metal part is exposed to a high temperature (for example, a temperature of 700° C. or higher), the metal part is oxidized, and in that case its strength deteriorates.

The present inventors consider that this is due to the following mechanism. When exposed to a high temperature of 700° C. or higher, bismuth (in a metallic state) is oxidized to form a bismuth oxide (hereinafter also referred to as an oxidation reaction). However, the space between the metal part and the other part is an enclosed space, and bismuth oxide is easily reduced. When the oxygen partial pressure in the enclosed space decreases, the bismuth oxide that was the product of the oxidation reaction is reduced to bismuth metal (hereinafter also referred to as a reduction reaction). The bismuth resulting from the reduction reaction reacts with a passive film formed on a surface of the metal part to remove the passive film. As a result, the surface of the metal part from which the passive film has been removed is oxidized.

Therefore, when bismuth or a bismuth oxide is present as the first solid lubricant, the anti-seizing agent of the present invention preferably contains at least one of copper oxide, thallium oxide, iridium oxide, osmium oxide, rhodium oxide and ruthenium oxide. By employing such an oxide, an oxygen component is supplied to the enclosed space, to thereby prevent the oxygen partial pressure in the enclosed space from lowering. Consequently, the reduction reaction can be suppressed. As a result, oxidation of the metal part can be prevented. Considering safety in production, cost and the like, the oxide is preferably copper oxide. The content e of the oxide is preferably 10 parts by weight≦e≦100 parts by weight when the sum of the contents of the first solid lubricant and the second solid lubricant is taken as 100 parts by weight. When e is less than 10 parts by weight, it is difficult to prevent the metal part from becoming oxidized. On the other hand, when e exceeds 100 parts by weight, the component ratio of the first solid lubricant and the second solid lubricant decreases, and the anti-seizing effect may deteriorate.

The anti-seizing agent of the invention can further contain a lubricant base oil, or a lubricant base oil and a thickening agent. Examples of the lubricant base oil include a mineral oil, a synthetic hydrocarbon oil, a polyalkylene glycol, a polyol ester, an alkyl-substituted diphenyl ether, and their mixed oils. However, the invention is not limited thereto.

Examples of the thickening agent for use in the anti-seizing agent of the present invention include a calcium sulfonate complex soap, lithium complex soap, calcium complex soap, lithium soap, calcium soap, organized bentonite, fine powdery silica, aliphatic diurea compounds, alicyclic diurea compounds, aromatic diurea compounds, triurea compounds and tetraurea compounds, suitable for use as a thickening agent for grease.

The content b of the lubricant base oil, or the sum of the contents of the lubricant base oil and the thickening agent is 90 parts by weight≦b≦400 parts by weight when the sum of the contents of the first solid lubricant and the second solid lubricant is taken as 100 parts by weight. When b is less than 90 parts by weight, fluidity of the anti-seizing agent is lost, and it is difficult to apply to a sliding surface of a part. On the other hand, when b exceeds 400 parts by weight, the effect of the solid lubricant is not exhibited, and therefore, it is difficult to obtain the anti-seizing effect.

Examples of other additives that may be contained in the anti-seizing agent include antioxidants, extreme-pressure additives, clean dispersants, rust preventives, putrefaction preventives, defoaming agents and diluents.

The anti-seizing agent of the present invention can further contain an organic resin. Examples of the organic resin include bisphenol F epoxy resins, bisphenol A epoxy resins, silicone resins and TYRANNO resins (trade name of Ube Industries, Ltd., comprising titanocarbosilane and polyalkylphenylsiloxane). However, the invention is not limited thereto.

The content c of the organic resin is 90 parts by weight≦c≦400 parts by weight when the sum of the contents of the first solid lubricant and the second solid lubricant is taken as 100 parts by weight. When c is less than 90 parts by weight, fluidity of the anti-seizing agent is lost, and it is difficult to apply to a sliding surface of a part. On the other hand, when c exceeds 400 parts by weight, the effect of the solid lubricant is not exhibited, and therefore, it is difficult to obtain the anti-seizing effect.

Examples of other additives that may be contained in the anti-seizing agent include ultraviolet absorbers, wetting dispersants, surface modifiers and curing agents.

The anti-seizing agent of the present invention can be used in a screw portion of a nut member for fitting a gas sensor to an exhaust pipe as shown in JP-A-11-190720, or in a gas sensor 1 described hereinafter, as an anti-seizing agent. The gas sensor 1 of the present embodiment is an example of one embodiment, and the invention should not be construed as being limited thereto. The gas sensor 1 (oxygen sensor) is fitted to an exhaust pipe of automobiles and detects concentration of oxygen in an exhaust gas. The FIGURE is a sectional view showing the overall structure of the gas sensor 1.

As shown in the FIGURE, the gas sensor 1 is provided with a sensor element 2 that is formed into a bottomed cylindrical shape having its leading end closed, a ceramic heater 3 inserted in the sensor element 2, and a metal shell 4 that holds the sensor element 2 inside the metal shell 4. Of directions along the axis of the sensor element 2 shown in the FIGURE, the side toward the leading end to be exposed to a gas to be measured (exhaust gas) (closed side, downside in the drawing) is called a "leading end side," and the side toward the direction opposite the above side (upside in the drawing) is called a "back-end side."

The sensor element 2 has a solid electrolyte body 21 having oxygen ion conductivity, an internal electrode 22 made of Pt or a Pt alloy formed on an inner surface of the solid electrolyte body 21, and an external electrode 23 formed on an outer surface of the solid electrolyte body 21. A flange portion 24 projecting toward an outer diameter direction is provided at a central position on an axial line of the sensor element 2. The ceramic heater 3 is formed in a rod shape, and is provided with a heating portion 31 having a heating element inside thereof.

The metal shell 4 has a screw portion 41 (corresponding to the fitting portion of the invention) for fitting the gas sensor 1 to the exhaust pipe, and a hexagonal portion 42 for engaging a fitting tool when fitting to the exhaust pipe. A gasket 5 is provided on the leading end side of the hexagonal portion 42. The surface of the screw portion 41 is coated with the anti-seizing agent of the present invention, thereby preventing seizing with the exhaust pipe even when the screw portion is fitted to the exhaust pipe and the metal shell 4 is exposed to a high temperature.

The metal shell 4 is provided with a fitting shoulder 43 projecting toward an inside diameter direction on an inner circumference of the leading end side, and a supporting member 7 made of alumina is supported on the fitting shoulder 43 through a packing 6. The flange portion 24 of the sensor element 2 is supported on the supporting member 7 through a packing 8. A filling member 9 is arranged between the inner surface of the metal shell 4 at the back-end side of the supporting member 7 and the outer surface of the sensor element 2, and a sleeve 100 and a circular ring 110 are successively interpolated on the back-end side of the filling member 9.

A double protector 120 made of a metal, having plural gas inlet holes 121, is fitted to the leading end side of the metal shell 4.

A leading end side of an inner cylinder member 130 is inserted in the inside of the back-end side of the metal shell 4. The inner cylinder member 130 is fixed to the metal shell 4 by crimping a back-end side 44 of the metal shell 4 in an inner leading end direction so that the leading end side contacts the circular ring 110. A structure in which the filling member 9 is compressed and filled through the sleeve 100 is obtained by crimping the back-end side 44 of the metal shell 4, and by means of this structure, the sensor element 2 is held inside the cylindrical metal shell 4 in an air-tight state.

Plural air introduction holes 131 are formed on the back-end side of the inner cylinder member 130 with a predetermined distance along a circumferential direction. A cylindrical filter 140 is arranged so as to cover the air introduction holes 131 of the inner cylinder member 130. Further, an outer cylinder member 150 is arranged so as to cover the filter 140. Plural air introduction holes 151 are formed on the position of the outer cylinder member 150 corresponding to the filter 140 with a predetermined distance along a circumferential direction.

A separator 160 is arranged inside the inner cylinder member 130. The separator 160 has a separator lead line through-hole 161 for inserting element lead wires 170 and 180, and heater lead wires 190 and 200 penetrate from the leading end side to the back-end side.

Further, each of the lead wires 170, 180, 190 and 200 (not shown in detail) has a structure such that a conductive wire is covered with an insulation coating film comprising a resin, and the back-end side of the conductive wire is connected to a connector terminal provided on a connector. The leading end side of the conductive wire of the element lead wire 170 is crimped together with the back-end side of a terminal fitting 210 outwardly fitted to the outer surface of the sensor element 2, and the leading end side of the conductive wire of the element lead wire 180 is crimped together with the back-end side of the terminal fitting 220 press fitted to the inner surface of the sensor element 2. In this manner, the element lead wire 170 is electrically connected to the external electrode 23 of the sensor element 2, and the element lead wire 180 is electrically connected to the internal electrode 22. On the other hand, the leading end sides of the conductive wires of the heater lead wires 190 and 200 are connected to a pair of terminal fittings 230, respectively, joined to a heating element of the ceramic heater 3.

A sealing material 240 having excellent heat resistance comprising a fluorine rubber or the like is fixed to the back-end side of the separator 160 by crimping the outer cylinder member 150. Four lead wire insertion holes 241 are formed on the sealing member 240 so as to penetrate in an axial line direction.

EXAMPLES

The present invention is described in greater detail by reference to the following Examples and Comparative Examples, but those are illustrative embodiments, and the invention should not be construed as being limited thereto.

Test Examples 1 to 33 were prepared by blending a first solid lubricant, a second solid lubricant, a lubricant base oil, a lubricant base oil plus a thickening agent, an organic resin, copper oxide, thallium oxide, iridium oxide, osmium oxide, rhodium oxide and ruthenium oxide in the blending proportions shown in Table 1. The preparation method of the Test Example is not particularly limited. The Test Example can generally be prepared by mixing and stirring a first solid lubricant, a second solid lubricant, a lubricant base oil, a lubricant base oil+a thickening agent, an organic resin, copper oxide, thallium oxide, iridium oxide, osmium oxide, rhodium oxide and ruthenium oxide, and if necessary, conducting dispersion treatment using a three-roll mill or a homogenizer.

A first solid lubricant, a second solid lubricant, a lubricant base oil, a lubricant base oil plus a thickening agent, an organic resin, copper oxide, thallium oxide, iridium oxide, osmium oxide, rhodium oxide and ruthenium oxide are all commercially available, industrial products.

TABLE 1

| | Test Example | | | | | | | | | | |
|---|---|---|---|---|---|---|---|---|---|---|---|
| | 1 | 2 | 3 | 4 | 5 | 6 | 7 | 8 | 9 | 10 | 11 |
| Bismuth*1 | 7 | 10 | 18 | 20 | | | 20 | 20 | | | 20 |
| Bismuth oxide*2 | | | | | 20 | 20 | | | 20 | 20 | |
| Graphite*3 | 33 | 30 | 22 | 20 | | | | 20 | | | |
| Molybdenum disulfide*4 | | | | | | 20 | | | 20 | | 20 |
| Boron nitride*5 | | | | | 20 | | 20 | | | 20 | |
| Mineral oil*6 | 45 | 45 | 45 | 45 | 45 | 45 | 45 | | | | |
| Calcium sulfonate complex soap*7 | 5 | 5 | 5 | 5 | 5 | 5 | 5 | | | | |
| Bisphenol F epoxy resin*8 | | | | | | | | 40.2 | 40.2 | 40.2 | 40.2 |
| Amine adduct curing agent*9 | | | | | | | | 1.8 | 1.8 | 1.8 | 1.8 |
| Dicyandiamide curing agent*10 | | | | | | | | 2.7 | 2.7 | 2.7 | 2.7 |
| Reactive diluent*11 | | | | | | | | 5.3 | 5.3 | 5.3 | 5.3 |
| Copper oxide*12 | 10 | 10 | 10 | 10 | 10 | 10 | 10 | 10 | 10 | 10 | 10 |
| Thallium oxide*13 | | | | | | | | | | | |
| Iridium oxide*14 | | | | | | | | | | | |
| Osmium oxide*14 | | | | | | | | | | | |
| Rhodium oxide*14 | | | | | | | | | | | |
| Ruthenium oxide*14 | | | | | | | | | | | |
| a | 17.5 | 25 | 45 | 50 | 50 | 50 | 50 | 50 | 50 | 50 | 50 |
| d | 82.5 | 75 | 55 | 50 | 50 | 50 | 50 | 50 | 50 | 50 | 50 |
| a/d | 0.2 | 0.3 | 0.8 | 1.0 | 1.0 | 1.0 | 1.0 | 1.0 | 1.0 | 1.0 | 1.0 |
| e | 25 | 25 | 25 | 25 | 25 | 25 | 25 | 25 | 25 | 25 | 25 |
| b | 125 | 125 | 12 | 125 | 125 | 125 | 125 | 0 | 0 | 0 | 0 |
| c | 0 | 0 | 0 | 0 | 0 | 0 | 0 | 125 | 125 | 125 | 125 |

| | Test Example | | | | | | | | | | |
|---|---|---|---|---|---|---|---|---|---|---|---|
| | 12 | 13 | 14 | 15 | 16 | 17 | 18 | 19 | 20 | 21 | 22 |
| Bismuth*1 | 30 | 35 | 36 | 37 | 16 | 16 | 16 | | 16 | | 16 |
| Bismuth oxide*2 | | | | | | | | 16 | | 16 | |
| Graphite*3 | 10 | 5 | 4 | 3 | 16 | 16 | 16 | | | 16 | 16 |
| Molybdenum disulfide*4 | | | | | | | | 16 | | | |
| Boron nitride*5 | | | | | | | | | 16 | | |
| Mineral oil*6 | 45 | 45 | 45 | 45 | 57 | 56 | 53 | 53 | | | 34 |
| Calcium sulfonate complex soap*7 | 5 | 5 | 5 | 5 | 8 | 7 | 7 | 7 | | | 4 |
| Bisphenol F epoxy resin*8 | | | | | | | | | 48.2 | 48.2 | |
| Amine adduct curing agent*9 | | | | | | | | | 2.2 | 2.2 | |
| Dicyandiamide curing agent*10 | | | | | | | | | 3.2 | 3.2 | |
| Reactive diluent*11 | | | | | | | | | 6.4 | 6.4 | |
| Copper oxide*12 | 10 | 10 | 10 | 10 | 3 | 5 | 8 | 8 | 8 | 8 | 30 |
| Thallium oxide*13 | | | | | | | | | | | |
| Iridium oxide*14 | | | | | | | | | | | |
| Osmium oxide*14 | | | | | | | | | | | |
| Rhodium oxide*14 | | | | | | | | | | | |
| Ruthenium oxide*14 | | | | | | | | | | | |
| a | 75 | 87.5 | 90 | 92.5 | 50 | 50 | 50 | 50 | 50 | 50 | 50 |
| d | 25 | 12.5 | 10 | 7.5 | 50 | 50 | 50 | 50 | 50 | 50 | 50 |
| a/d | 3.0 | 7.0 | 9.0 | 12.3 | 1.0 | 1.0 | 1.0 | 1.0 | 1.0 | 1.0 | 1.0 |
| e | 25 | 25 | 25 | 25 | 9.4 | 15.6 | 25 | 25 | 25 | 25 | 93.8 |

TABLE 1-continued

| | | | | | | | | | | | |
|---|---|---|---|---|---|---|---|---|---|---|---|
| b | 125 | 125 | 125 | 125 | 203.1 | 196.9 | 187.5 | 187.5 | 0 | 0 | 118.8 |
| c | 0 | 0 | 0 | 0 | 0 | 0 | 0 | 0 | 187.5 | 187.5 | 0 |

| | Test Example | | | | | | | | | | |
|---|---|---|---|---|---|---|---|---|---|---|---|
| | 23 | 24 | 25 | 26 | 27 | 28 | 29 | 30 | 31 | 32 | 33 |
| Bismuth*1 | 16 | 25 | 23 | 10 | 8 | 8 | 25 | 23 | 10 | 9 | 8 |
| Bismuth oxide*2 | | | | | | | | | | | |
| Graphite*3 | 16 | 25 | 23 | 10 | 9 | 8 | 25 | 23 | 10 | 9 | 8 |
| Molybdenum disulfide*4 | | | | | | | | | | | |
| Boron nitride*5 | | | | | | | | | | | |
| Mineral oil*6 | 30 | 35 | 39 | 62 | 64 | 65 | | | | | |
| Calcium sulfonate complex soap*7 | 3 | 5 | 5 | 8 | 8 | 8 | | | | | |
| Bisphenol F epoxy resin*8 | | | | | | | 32.5 | 35.5 | 56.3 | 57.9 | 59.5 |
| Amine adduct curing agent*9 | | | | | | | 1.4 | 1.5 | 2.5 | 2.6 | 2.7 |
| Dicyandiamide curing agent*10 | | | | | | | 2.2 | 2.4 | 3.8 | 3.9 | 4 |
| Reactive diluent*11 | | | | | | | 4.2 | 4.6 | 7.4 | 7.6 | 7.8 |
| Copper oxide*12 | 35 | 10 | 10 | 10 | 10 | 10 | 10 | 10 | 10 | 10 | 10 |
| Thallium oxide*13 | | | | | | | | | | | |
| Iridium oxide*14 | | | | | | | | | | | |
| Osmium oxide*14 | | | | | | | | | | | |
| Rhodium oxide*14 | | | | | | | | | | | |
| Ruthenium oxide*14 | | | | | | | | | | | |
| a | 50 | 50 | 50 | 50 | 50 | 50 | 50 | 50 | 50 | 50 | 50 |
| d | 50 | 50 | 55 | 50 | 50 | 50 | 50 | 50 | 50 | 50 | 50 |
| a/d | 1.0 | 1.0 | 1.0 | 1.0 | 1.0 | 1.0 | 1.0 | 1.0 | 1.0 | 1.0 | 1.0 |
| e | 109.4 | 20 | 21.7 | 50 | 55.6 | 62.5 | 20 | 21.7 | 50 | 55.6 | 62.5 |
| b | 103.1 | 80 | 95.7 | 350 | 400 | 462.5 | 0 | 0 | 0 | 0 | 0 |
| c | 0 | 0 | 0 | 0 | 0 | 0 | 80 | 95.7 | 350 | 400 | 462.5 |

*1Product of Sumitomo Metal Mining Co., Ltd.
*2Product of Nissan Kagaku Sangyo Co., Ltd.
*3Scale-like graphite
*4Product of IPROS Corporation
*5DENKA BORON NITRIDE HGP, a product of Denki Kagaku Kogyo K.K.
*6SNH-46, a product of Sankyo Yuka Kogyo K.K.
*7G-2000, a product of Krompton
*8EPICRON 830S, a product of Dainippon Ink and Chemicals, Incorporated
*9AMICURE PN-23, a product of Ajinomoto Fine-Techno Co., Inc.
*10AMICURE AH-154, a product of Ajinomoto Fine-Techno Co., Inc.
*11Alkylene monoglycidyl ether having viscosity at 25° C. of 6.5 to 9.0 mPa · s and an epoxy equivalent of 280 to 320 g/eq.
*12Cupric oxide, a product of Nissan Kagaku Sangyo Co., Ltd.
*13Commercially available reagent (made in USA)
*14Commercially available reagent (made in Japan).

The numerical value in Table 1 shows a blending proportion (weight % or part by weight). The average particle diameter of graphite in Table 1 is 30 μm or less.

(Evaluation of Workability)

An evaluation was conducted in which about 60 mg of each of the anti-seizing agents of Test Examples 1 to 33 shown in Table 1 above were applied to the screw portion 41 of the metal shell 4 used in the gas sensor 1 described above. The evaluation results are shown in Table 2.

(Evaluation of Anti-Seizing Effect)

About 60 mg of the anti-seizing agent was applied to the screw portion 41 of the metal shell 4 used in the gas sensor 1 described above, and the metal shell 4 was screwed into a sample nut with a torque of 60 N·m. The metal shell 4 is made of SUS 430, and the sample nut is made of SUS 409L. This evaluation was conducted using a metal shell 4 prior to fitting to the gas sensor 1, and by screwing the metal shell 4 (no gas sensor) into the nut. The metal shell 4 and the nut thus unified were then heated in an electric oven at 500° C. or 700° C. for 100 hours. The unified product was cooled to room temperature, and the metal shell 4 was loosened from the nut. This test procedure was applied to ten test samples. The proportion of the number of metal shells 4 exhibiting seizing is expressed by percentage, and indicated as a degree of seizing (%). The term "exhibiting seizing" indicates a state in which when the metal shell 4 is loosened by hand using a torque trench, the metal shell 4 is not unscrewed from the nut. In this case, when the metal shell 4 is loosened with further strong force, the thread of the screw portion 41 of the metal shell 4 is crushed. The evaluation was conducted on the basis of the degree of seizing as follows.

◎: Degree of seizing is 0%.
O: Degree of seizing exceeds 0% but is 5% or less.
Δ: Degree of seizing exceeds 5% but is 20% or less.
X: Degree of seizing exceeds 20%.

The evaluation results of Test Examples 1 to 33 are shown in Table 2.

(Evaluation of Corrosion Resistance)

About 60 mg of each of Test Examples 1 to 33 prepared as shown in Table 1 was applied to the screw portion 41 of the metal shell 4 used in the gas sensor 1 described above, and the metal shell 4 was screwed into a sample nut with a torque of 60 N·m. The metal shell 4 is made of SUS 430, and the sample nut is made of SUS 409L. This evaluation was conducted using a metal shell 4 prior to fitting to the gas sensor 1, and by screwing the metal shell 4 (no gas sensor) into the nut. The metal shell 4 and the nut thus unified were then heated in an electric oven at 500° C. or 700° C. for 100 hours. The unified product was cooled to room temperature, and the metal shell 4 was loosened from the nut. The metal shell 4 was divided into halves, and a cross section of the screw portion 41 was subjected to component mapping with EDS (Energy Dispersive X-ray Spectroscopy). Of the component mappings, a thickness from which oxygen was detected was calculated as an oxide film thickness. An evaluation of an oxide film thickness of 20 μm or greater was graded X, and an oxide film thickness of less than 20 μm was graded ○. The evaluation results are shown in Table 2.

TABLE 2

| | Test Example | | | | | | | | | | |
|---|---|---|---|---|---|---|---|---|---|---|---|
| | 1 | 2 | 3 | 4 | 5 | 6 | 7 | 8 | 9 | 10 | 11 |
| Seizing 500° C. | Δ | Δ | ◎ | ◎ | ○ | ○ | ○ | ◎ | ○ | ◎ | ○ |
| Seizing 700° C. | Δ | ○ | ◎ | ◎ | ◎ | ○ | ○ | ◎ | ◎ | ◎ | ◎ |
| Corrosion resistance | ○ | ○ | ○ | ○ | ○ | ○ | ○ | ○ | ○ | ○ | ○ |
| Workability | ○ | ○ | ○ | ○ | ○ | ○ | ○ | ○ | ○ | ○ | ○ |

| | Test Example | | | | | | | | | | |
|---|---|---|---|---|---|---|---|---|---|---|---|
| | 12 | 13 | 14 | 15 | 16 | 17 | 18 | 19 | 20 | 21 | 22 |
| Seizing 500° C. | ◎ | ○ | Δ | Δ | ◎ | ◎ | ◎ | ○ | ○ | ○ | ○ |
| Seizing 700° C. | ◎ | ◎ | ○ | Δ | ◎ | ◎ | ◎ | ○ | ◎ | ○ | ○ |
| Corrosion resistance | ○ | ○ | ○ | ○ | | ○ | ○ | ○ | ○ | ○ | ○ |
| Workability | ○ | ○ | ○ | ○ | ○ | ○ | ○ | ○ | ○ | ○ | ○ |

| | Test Example | | | | | | | | | | |
|---|---|---|---|---|---|---|---|---|---|---|---|
| | 23 | 24 | 25 | 26 | 27 | 28 | 29 | 30 | 31 | 32 | 33 |
| Seizing 500° C. | Δ | — | ○ | ○ | ○ | Δ | — | ○ | ○ | ○ | Δ |
| Seizing 700° C. | ○ | — | ○ | ○ | ○ | ○ | — | ◎ | ◎ | ○ | ○ |
| Corrosion resistance | ○ | — | ○ | ○ | ○ | ○ | — | ○ | ○ | ○ | ○ |
| Workability | ○ | | ○ | ○ | ○ | ○ | | ○ | ○ | ○ | ○ |

In the seizing agents of Test Examples 1 to 33 of the present invention using at least one of bismuth and bismuth oxide as the first solid lubricant; graphite, molybdenum disulfide or boron nitride as the second solid lubricant; a mineral oil as the lubricant base oil, a grease obtained by thickening the mineral oil with calcium sulfonate complex soap as a thickening agent, or bisphenol F epoxy resin; and at least one of copper oxide, thallium oxide, iridium oxide, osmium oxide, rhodium oxide and ruthenium oxide, Test Example 1 having a graphite content of as large as d=82.4, exhibited a poor anti-seizing effect. In Test Example 15 where the bismuth content was as large as a=92.5, the anti-seizing effect was also found to be poor. In Test Example 2, the ratio of graphite to bismuth was a/d=0.3, and the anti-seizing effect was slightly poor. In Test Example 14 the ratio of graphite to bismuth was a/d=9, and the anti-seizing effect was slightly poor. In Test Example 16 the copper oxide content e was 9.4, and the corrosion resistance was poor. In Test Example 23 the copper oxide content e was 109, and the corrosion resistance was poor. In Test Example 24 the lubricant base oil content b was 80, and the workability was poor. In Test Example 28 the lubricant base oil content b was 462, and the corrosion resistance was poor. In Test Example 29 the organic resin content c was 80, and the workability was poor. In Test Example 33 the organic resin content c was 462, and the corrosion resistance was poor.

When the screw portion of the gas sensor 1 was analyzed, the bismuth component was found to be present on substantially the entire outer surface thereof. Before the screw portion of the gas sensor 1 and the nut were fastened, the anti-seizing agent evenly covered the outer surface of the screw portion 41. However, when the screw portion was fitted to the nut, the anti-seizing agent covering the outer surface of the screw portion 41 became unevenly distributed. That is, relatively large amounts of the anti-seizing agent were present at the top of threads and at the bottom of the valleys of the screw portion 41, while being scarce or lacking in the middle between the top of the threads and the bottom of the valleys of the screw portion 41. After being heated to a temperature of 270° C. or higher, i.e. 700° C., the bismuth in the anti-seizing agent melts and penetrates the entire interface between the screw portion 41 and the nut, including the middle between the top of the threads and the bottom of the valleys of the screw portion 41. As a result, there is no area where the screw portion 41 and the nut are in direct contact, thereby preventing seizing between the screw portion 41 and the nut when sliding one surface against the other. The term "the bismuth component of the anti-seizing agent remains on a central portion of the outer surface of the fitting part," as used herein means that when the central portion surface of the outer surface (in the case of the screw portion 41, the central portion on the surface between thread and valley) is subjected to EDS analysis, a peak of bismuth is observed, and therefore, the bismuth component is determined to be present.

This application is based on Japanese Patent Application JP 2005-341440, filed Nov. 28, 2005, and Japanese Patent Application JP 2006-259640, filed Sep. 25, 2006, the entire contents of which are hereby incorporated by reference, the same as if set forth at length.

What is claimed is:

1. A sensor comprising a detecting element for detecting a state of a gas to be measured, and a metal shell that holds the detecting element, the metal shell including a fitting part for fitting the detecting element to an exhaust pipe when the detecting element is exposed to a gas to be measured, wherein an anti-seizing agent is present at an outer surface of the fitting part, said anti-seizing agent comprising:

a first solid lubricant containing at least one of metallic bismuth and bismuth oxide; and a second solid lubricant containing at least one of graphite, molybdenum disulfide and boron nitride, a lubricant base oil; and a thickening agent selected from the group consisting of a calcium sulfonate complex soap, a lithium complex soap, a calcium complex soap, a lithium soap, a calcium soap, an organized bentonite, powdery silica, an aliphatic diurea compound, an alicyclic diurea compound, an aromatic diurea compound, a triurea compound and a tetraurea compound, wherein the anti-seizing agent satisfies 20 weight %≦a≦90 weight % and 10 weight %≦d≦80 weight %, in which a sum of the contents of the first solid lubricant and the second solid lubricant in the anti-seizing agent is taken as 100 weight %, and a represents the content of the first solid lubricant and d represents the content of the second solid lubricant, and when a sum of the contents of the first solid lubricant and the second solid lubricant is taken as 100 parts by weight, a sum b of the contents of lubricant base oil and the thickening agent satisfies 90 parts by weight≦b≦400 parts by weight.

2. An assembly comprising: a sensor including a detecting element for detecting a state of a gas to be measured and a metal shell that holds the detecting element; and an exhaust pipe for fitting a fitting part formed on the metal shell to expose the detecting element to a gas to be measured, wherein an anti-seizing agent is present between an outer surface of the fitting part of the metal shell and a surface of the exhaust pipe that fits the fitting part when the sensor and the exhaust pipe are assembled, and after the fitting part is heated to a temperature of not less than 270° C., a bismuth component of the anti-seizing agent remains on a central portion of the outer surface of the fitting part, said anti-seizing agent comprising:

a first solid lubricant containing at least one of metallic bismuth and bismuth oxide; and a second solid lubricant containing at least one of graphite, molybdenum disulfide and boron nitride, a lubricant base oil; and a thickening agent selected from the group consisting of a calcium sulfonate complex soap, a lithium complex soap, a calcium complex soap, a lithium soap, a calcium soap, an organized bentonite, powdery silica, an aliphatic diurea compound, an alicyclic diurea compound, an aromatic diurea compound, a triurea compound and a tetraurea compound, wherein the anti-seizing agent satisfies 20 weight %≦a≦90 weight % and 10 weight %≦d≦80 weight %, in which a sum of the contents of the first solid lubricant and the second solid lubricant in the anti-seizing agent is taken as 100 weight %, and a represents the content of the first solid lubricant and d represents the content of the second solid lubricant, and when a sum of the contents of the first solid lubricant and the second solid lubricant is taken as 100 parts by weight, a sum b of the contents of lubricant base oil and the thickening agent satisfies 90 parts by weight≦b≦400 parts by weight.

3. The sensor as claimed in claim 1, wherein the contents of the first solid lubricant and the second solid lubricant of the anti-seizing agent satisfy 0.8≦a/d≦8.

4. The sensor as claimed in claim 1, wherein the anti-seizing agent further comprises an antioxidant comprising at least one of copper oxide, thallium oxide, iridium oxide, osmium oxide, rhodium oxide and ruthenium oxide, and when a sum of the contents of the first solid lubricant and the second solid lubricant is taken as 100 parts by weight, content of the antioxidant e satisfies 10 parts by weight≦e≦100 parts by weight.

5. The assembly as claimed in claim 2, wherein the contents of the first solid lubricant and the second solid lubricant of the anti-seizing agent satisfy 0.8≦a/d≦8.

6. The assembly as claimed in claim 2, wherein the anti-seizing agent further comprises an antioxidant comprising at least one of copper oxide, thallium oxide, iridium oxide, osmium oxide, rhodium oxide and ruthenium oxide, and when a sum of the contents of the first solid lubricant and the second solid lubricant is taken as 100 parts by weight, a content of the antioxidant e satisfies 10 parts by weight≦e≦100 parts by weight.

7. A sensor comprising a detecting element for detecting a state of a gas to be measured, and a metal shell that holds the detecting element, the metal shell including a fitting part for fitting the detecting element to an exhaust pipe when the detecting element is exposed to a gas to be measured, wherein an anti-seizing agent is present at an outer surface of the fitting part, said anti-seizing comprising:

a first solid lubricant containing at least one of metallic bismuth and bismuth oxide; and a second solid lubricant containing at least one of graphite, molybdenum disulfide and boron nitride, a lubricant base oil;

wherein the anti-seizing agent satisfies 20 weight %≦a≦90 weight % and 10 weight %≦d≦80 weight %, in which a sum of the contents of the first solid lubricant and the second solid lubricant in the anti-seizing agent is taken as 100 weight %, and a represents the content of the first solid lubricant and d represents the content of the second solid lubricant, and when a sum of the contents of the first solid lubricant and the second solid lubricant is taken 100 parts by weight, a sum b of the contents of lubricant base oil satisfies 90 parts by weight≦b≦400 parts by weight.

8. An assembly comprising:

a sensor comprising a detecting element for detecting a state of a gas to be measured and a metal shell that holds the detecting element; and an exhaust pipe for fitting a fitting part formed on the metal shell to expose the detecting element to a gas to be measured, wherein an anti-seizing agent is present between an outer surface of the fitting part of the metal shell and a surface of the exhaust pipe that fits the fitting part when the sensor and the exhaust pipe are assembled, and after the fitting part is heated to a temperature of not less than 270° C., a bismuth component of the anti-seizing agent remains on a central portion of the outer surface of the fitting part, said anti-seizing agent comprising:

a first solid lubricant containing at least one of metallic bismuth and bismuth oxide; and a second solid lubricant containing at least one of graphite, molybdenum disulfide and boron nitride, a lubricant base oil;

wherein the anti-seizing agent satisfies 20 weight %≦a≦90 weight % and 10 weight %≦d≦80 weight %, in which a sum of the contents of the first solid lubricant and the second solid lubricant in the anti-seizing agent is taken as 100 weight %, and a represents the content of the first solid lubricant and d represents the content of the second solid lubricant, and when a sum of the contents of the first solid lubricant and the second solid lubricant is taken as 100 parts by weight, a sum b of the contents of lubricant base oil satisfies 90 parts by weight≦b≦400 parts by weight.

* * * * *